US005362066A

United States Patent [19]

Sassak

[11] Patent Number: 5,362,066

[45] Date of Patent: Nov. 8, 1994

[54] AERIAL THROWING GAME

[76] Inventor: Mark S. Sassak, 1340 Linden, Plymouth, Mich. 48170

[21] Appl. No.: 14,730

[22] Filed: Feb. 8, 1993

Related U.S. Application Data

[63] Continuation-in-part of Ser. No. 827,404, Jan. 29, 1992, Pat. No. 5,240,257.

[51] Int. Cl.[5] ..... A63B 65/00; A63B 67/00

[52] U.S. Cl. ..... 273/344; 273/346; 273/348; 273/412; 273/417; 273/425; 273/428; 273/DIG. 25; 273/DIG. 30

[58] Field of Search ..... 273/344, 346, 424, 425, 273/428, DIG. 25, DIG. 30, 412, 417, 67 R, 67 B, 348

[56] References Cited

U.S. PATENT DOCUMENTS

| | | | |
|---|---|---|---|
| D. 122,424 | 9/1940 | Singer | 273/344 X |
| 429,953 | 6/1890 | Pratt | 273/344 |
| 2,187,524 | 1/1940 | Price | 273/344 |
| 2,745,666 | 5/1956 | Schwartz | 273/412 X |
| 3,954,266 | 5/1976 | Carrano et al. | 273/412 X |
| 4,017,076 | 4/1977 | Bai | 273/346 |
| 4,049,271 | 9/1977 | Fonti | 273/346 |
| 4,832,348 | 5/1989 | Exel | 273/344 |
| 4,995,617 | 2/1991 | Lee | 273/346 |
| 5,066,017 | 11/1991 | Kurland | 273/344 |
| 5,085,442 | 2/1992 | Lee | 273/346 |
| 5,165,684 | 11/1992 | Pratt | 273/67 B |
| 5,203,572 | 4/1993 | Lirn | 273/344 |
| 5,240,257 | 8/1993 | Sassak | 273/344 |

*Primary Examiner*—William H. Grieb
*Attorney, Agent, or Firm*—Harness, Dickey & Pierce

[57] ABSTRACT

An aerial dart throwing game including a hand-held dart catcher, fixed and removable targets for temporarily holding, respectively, only a first and a second projectile thrown thereagainst, and connection arrangements to selectively detach the targets to the catcher structure. The projectile preferably includes a shuttlecock-like body having a leading end with a suction cup or a Velcro® portion.

34 Claims, 5 Drawing Sheets

AERIAL THROWING GAME

This application is a continuation-in-part of Ser. No. 827,464, now U.S. Pat No. 5,240,257, filed Jan. 29, 1992, issued Aug. 31, 1993.

CROSS-REFERENCE TO RELATED APPLICATION

This application is a continuation-in--part of pending application Ser. No. 07/827,404 filed Jan. 29, 1992.

BACKGROUND OF THE

1. Technical Field

This invention relates to an aerial dart throwing game and, more particularly, to a target structure which allows the participants the opportunity to play a variety of aerial throwing games. A projectile, such as a shuttlecock having a suction cup or VELCRO ® on a leading end, is directed at the target structure which comprises a backing member provided with an adjustable hand strap for holding the target structure, and a plate-like target member removably mounted to the backing member.

2. Discussion

A number of different types of throwing games utilizing darts or shuttlecocks which include suction cups which are directed at a target structure are known in the art. One such throwing game is disclosed in U.S. Pat. No. 4,832,348 by Exel, which discloses a catch plate having a chambered front side and a holding loop on the rear side. The shuttlecock-like throwing body includes a suction cup for adherence wherein the throwing body is directed at the catch plate. Traditionally, the target structures of the known aerial dart or shuttlecock throwing games tend to offer reduced adherence by the aerial dart or shuttlecock to the catch plate. Additionally, the target structures of the previously known aerial dart or shuttlecock games are generally incapable of being adapted to a variety of games.

It is accordingly the primary object of the present invention to provide an aerial throwing game in which the target structure has improved adhesion characteristics to facilitate adhesion by the dart or shuttlecock throwing member.

It is another object of the present invention to provide an aerial throwing game apparatus which is adaptable for playing a variety of different games.

Additional objects and advantages of the present invention will become apparent from a reading of the detailed description of the preferred embodiments which made reference to the following sets of drawings.

DETAILED DESCRIPTION OF THE PREFERRED EMBODIMENT

Figure 1:
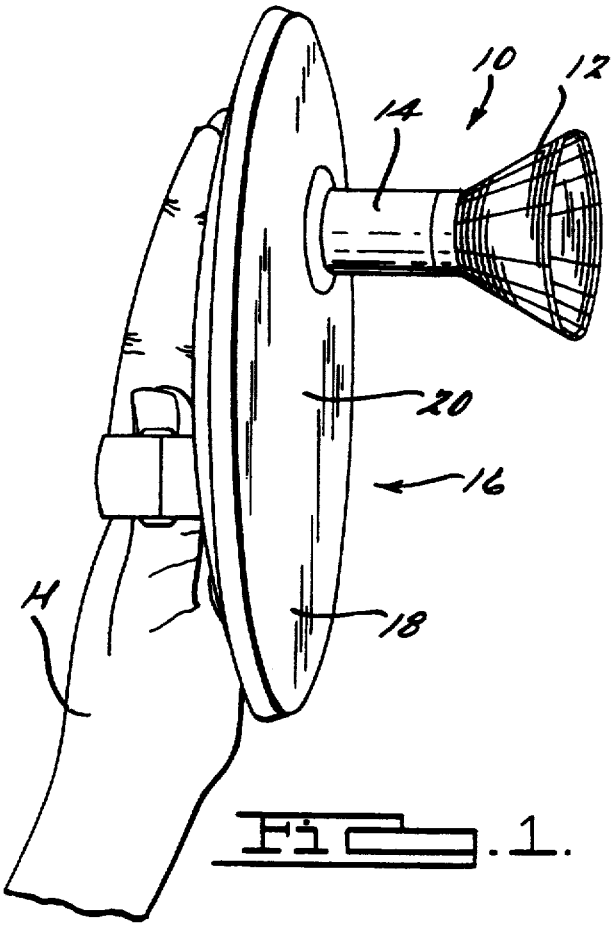
FIG. 1 is a perspective view of an aerial target structure according to the present invention showing a throwing member directed upon a target plate.

Turning now to the drawings, FIG. 1 is a perspective view according to the present invention showing a target structure 16 secured to the hand "H" of a player and a projectile 10 engaging the target structure 16. The game of the present invention is intended to be played by two or more people by directing the projectile 10 in the direction of the target structure 16. The target structure 16 is manipulated by the player into a position intercepting the line of flight of the projectile, thrown by another player, whereby to receive and temporarily hold the projectile.

Figure 3:
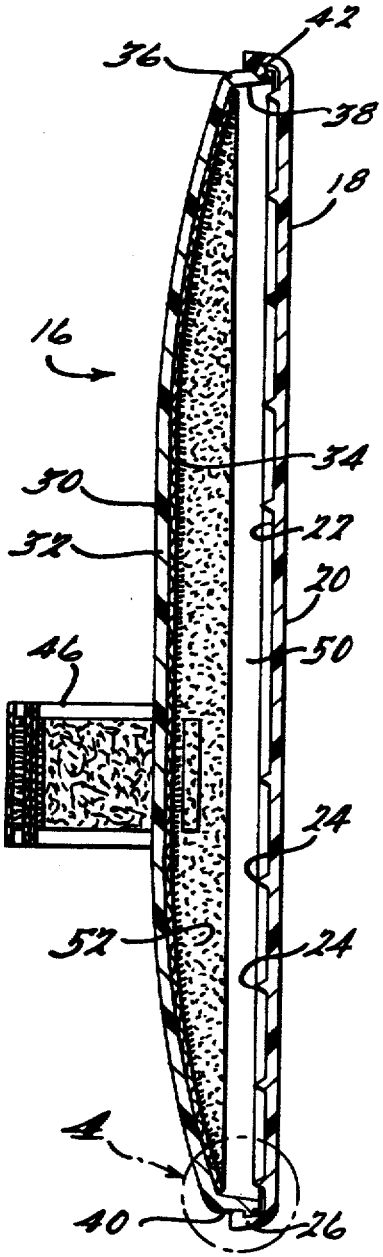
FIG. 3 is a cross-sectional side view of the present invention taken along lines 3—3 of FIG. 2.
Figure 4:
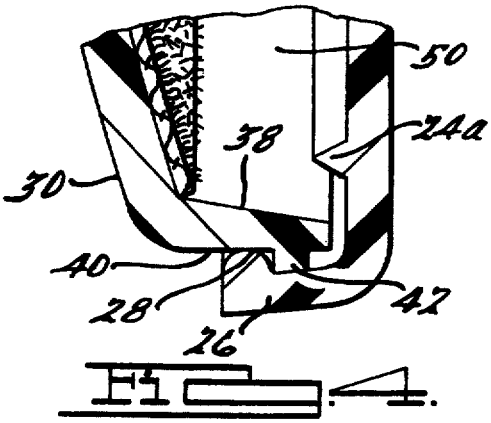
FIG. 4 is an enlarged fragmentary view showing the connection between the components which form the target structure of the present invention.

Referring to FIGS. 3 and 4, cross-sectional views showing the target structure 16 in an assembled position are provided. The backing member 30, which has an overall concave shape, includes an outer surface 32 and an inner surface 34. Projecting upwardly along the periphery of the inner surface 34 is a lip 36 which has an inner wall 38 and an outer wall 40. The outer wall 40 is further provided with an outwardly projecting annular surface 42. Slots 44 are provided on the backing member 30 to provide points of attachment for a strap 46 which allows the player to rotate the backing member 30 to a desired position. The inner surface 34 can be lined with a variety of target surfaces. For example, one such surface 52 is a sheet comprised of a hook and loop fastener material sold under the trademark Velcro ® which sheet can be adhered to the inner surface so that a projectile having Velcro ® padding can be directed against and temporarily adhered to the sheet.

The plate member 18 includes a relatively flat outer surface 20 having any one of a number of different designs for adherence of the projectile 10. For example, it is contemplated that a dart-type scoreboard can be provided on the outer surface 20 wherein points are scored by adhering the projectile within certain areas on the outer surface 20 of plate number 18. Plate number 18 also includes an inner surface 22 having a plurality of ribs 24 extending downward from the inner surface 22 in a spaced apart relation. These ribs 24 are intended to provide the plate member 18 with structural support. The plate member 18 further includes a projecting lip 26 located along the periphery of the inner surface 22. The top of the lip 26 is provided with an inwardly projecting flange 28 which provides an abutting surface to secure the plate member 18 to the backing member 30.

Figure 2:
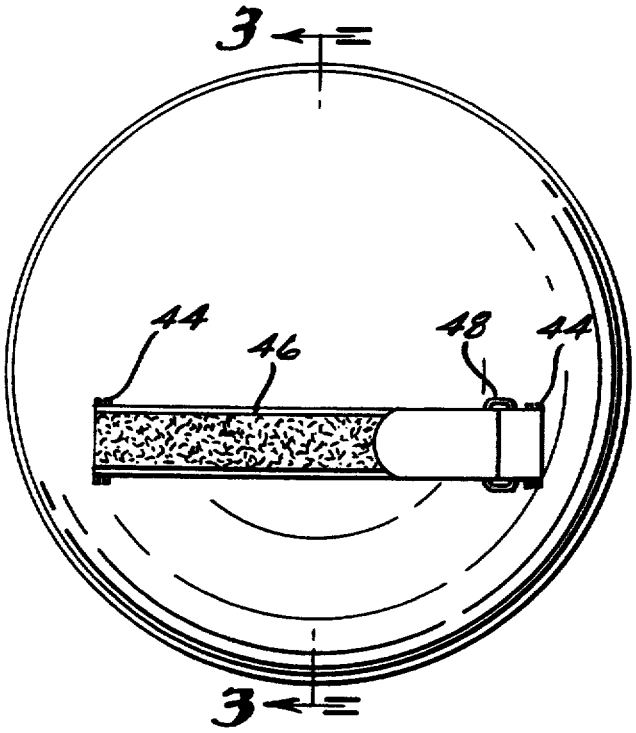
FIG. 2 is a rear view of the present invention showing a backing plate and a selectively movable and adjustable strap.

Prior to combining the plate member 18 and backing member 30 to form target structure 16, the strap 46 is drawn through the slots 44 to allow an individual to control the position of the target structure. As shown more clearly in FIG. 2, the strap 46 has a buckle 48 contained on a first end through which the second end of the strap is looped. When the strap 46 has been drawn through the slots 44 and looped through buckle 48, the second end is folded back over the body of the strap. The second end of the strap is provided with Velcro® material and the body of the strap is provided with Velcro® material which allows the strap to be adjusted and locked in the desired position.

Once the strap 46 has been looped through backing member 30, the plate member 18 and the backing member 30 can be combined to form the target structure 16. The inwardly projecting flange 28 of plate member 18 is snapped over the outwardly projecting annular surface 42 of the backing member 30 until the annular surface is fully contained underneath flange 28. As the flange 28 is initially being snapped over annular surface 42, the outermost rib 24a, which extends from the inner surface 22 of plate member 18, helps to preclude misalignment of the plate member 18.

Importantly, the design of the present invention provides for an air gap 50 between the inner surface 34 of the backing member 30 and the inner surface 22 of the plate member 18 when the plate member 18 is locked over the backing member 30. This air gap 50 allows the outer surface of the plate member 18 to flex inwardly slightly as it is contacted by the projectile 10. This flexing increases the likelihood that the projectile will adhere to the outer surface of the plate member 18.

As noted, it will be understood that the outer surface 20 of the plate member 18 can be provided with a plurality of different adhering surfaces at which any one of a number of different types of projectiles can be directed within the scope of the present invention. In the preferred embodiment, the surface has a smooth, glossy finish which is a result of the molding process or can be provided by a laminate coating, such as a thin paper film, applied after the plate member has been molded. The projectile 10 for adherence to the outer surface 20 of plate member 18 preferably has a shuttlecock-like body 12 incorporating a suction cup 14 on its leading end. The neck of the shuttlecock is elongated and enables the person throwing the shuttlecock to grip it with all four fingers and the thumb. This allows the person throwing the shuttlecock to project it in a more accurate direction.

Figure 5:
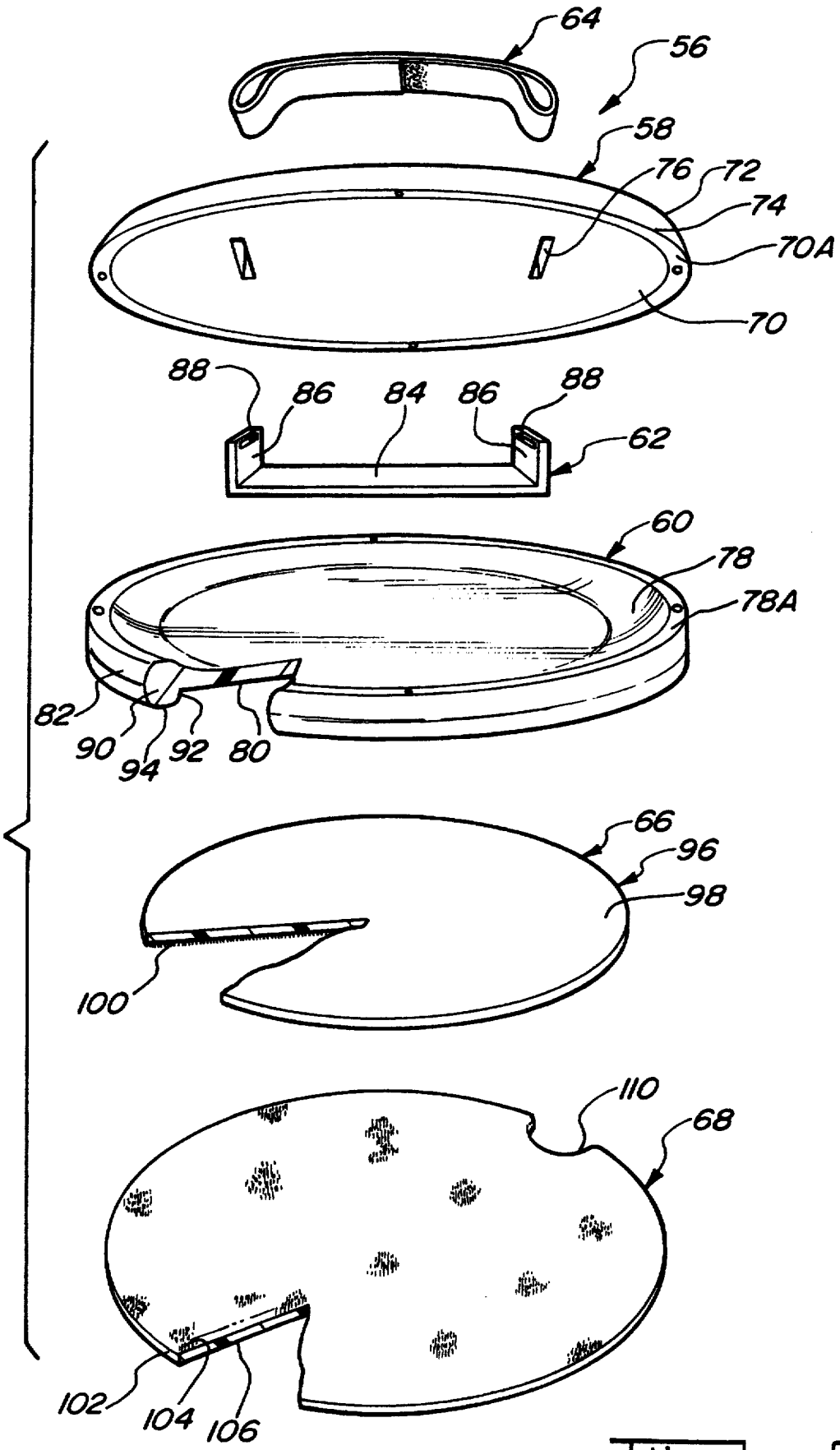
FIG. 5 is an exploded assembly view of another embodiment of an aerial target structure according to the present invention.

FIGS. 5–9 illustrate another embodiment of an aerial target game according to this invention. Turning to FIG. 5, a target catcher 56 includes a backing member 58, a target holder 60, a U-shaped handle holder 62 adapted to be sandwiched between the backing member and the target holder, a strap 64 adapted to be adjustably positioned on the holder 62, a first target 66 adapted to be nonremovably fixed to the target holder 60, and a second target 68 adapted to be removably connected to the target holder 60. The removability of the second target allows a player to have the target catcher held on one hand and use the other hand to expose the first target and select between different games.

The backing member 58 and target holder 60 are formed into a generally cylindrical shape from a relatively rigid polymeric material and are adapted to be secured together to form an integral "catcher's mit" which can be held on the player's hand by the strap 64. The backing member 58 includes inner and outer surfaces 70 and 72, an outer periphery 74, and a pair of slots 76 which extend between the surfaces. The outer surface is somewhat concave so as to fit the curvature of the user's palm.

The target holder 60 includes inner and outer surfaces 78 and 80 and an outer periphery 82. An annular portion of each inner surface 70 and 78 define mating face portions 70A and 78A which are secured together, such as by a suitable adhesive, whereby to form the integral catcher's mit. The outer periphery 82 is substantially identical to the outer periphery 74 such that one smooth outer periphery is presented when the target holder 60 is joined to the backing member 58. The central region of the inner surface 78 is slightly concave (i.e., "dished") and cooperates with the generally planar inner surface 70 to form a central recess for receiving the handle holder 62.

The handle holder 62 includes an elongated body 84 which engages the inner surfaces 70 and 78 and a pair of arms 86 each having an opening 88. The body 84 is adapted to be fixedly secured to the inner surface 70, such as by a suitable adhesive, and the arms 86 are adapted to extend through the respective slots 76 whereby to close the slots and seal the central recess and position the openings 88 above the outer surface 72 whereby to receive the strap 64. As described above, the strap could be selectively comprised of Velcro® material whereby to allow ease of adjustability to receive and tighten about a hand inserted between the strap and the outer surface 72.

An important aspect of this invention resides in the manner in which the user can change from the use of one target to the use of another target. While the target catcher 56 is held by the strap on one hand of the player, the other hand can be used to change the targets and permit the player to rapidly adjust to play a different game.

Figure 6:
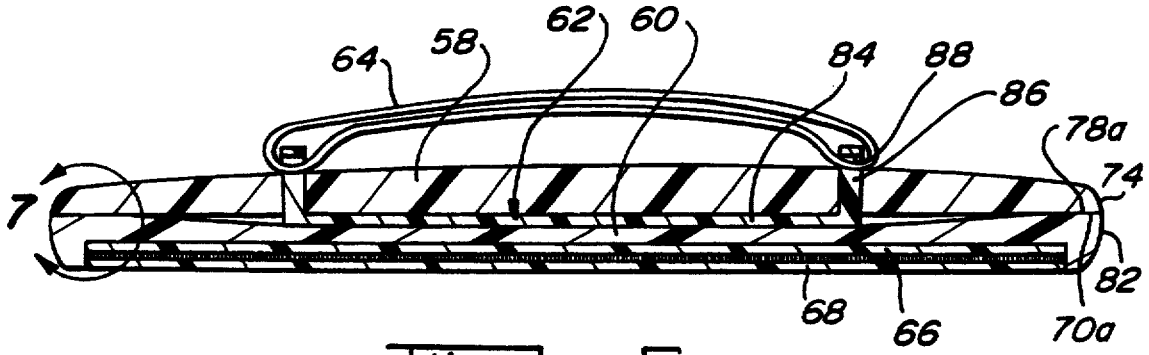
FIG. 6 is a cross-sectional view of the target structure of FIG. 5.
Figure 7:
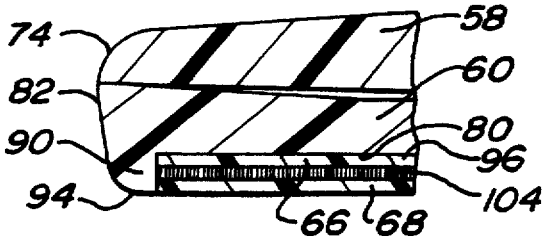
FIG. 7 is an enlarged fragmentary sectional view taken along line 7—7 of FIG. 6 showing the connection between the components of the target structure.

Turning to FIGS. 5–7, the target holder 60 is formed to include a continuous cylindrical wall 90 that projects upwardly from the outer surface 80. The wall 90 defines the outer periphery 82, a cylindrical inner face 92, and a front end face 94 of the target catcher whereby to recess the outer surface 80 from the front end face of the target holder. A flat circular plate 96 has an outer periphery corresponding to the configuration of the inner face 92, a bottom sur face 98 adapted to be adhered to the outer surface 80 and a top surface 100 provided with Velcro® material so arranged as to form the first target 66 to temporarily hold a projectile thrown thereagainst. If desired, the Velcro® material could be adhered directly onto the outer surface 80.

The second target 68 comprises a flat circular plate having an outer periphery 102 corresponding to the configuration of the inner face 92 and adapted to nest within the recess formed between the outer surface 80 and the front end face 94. The target plate 68 has a bottom surface 104 provided with Velcro® material, at least in selected areas, to permit the target plate 68 to be removably attached to the Velcro® portion 100 on the target 66, and a top surface 106 forming the second target. Preferably, the target plate 68 would be comprised of a rigid material and the top surface 106 would present a smooth glossy surface to receive the above-described dart provided with a suction cup.

According to this invention, the projectile for the first target 66 could comprise a ball having strips of Velcro® material provided thereon. Additionally, the projectile could also comprise the dart, as shown and described above in connection with FIG. 1, but wherein the forward end portion thereof is replaceable to accept either the suction cup or a like-shaped end element provided with Velcro® material.

Figure 8:
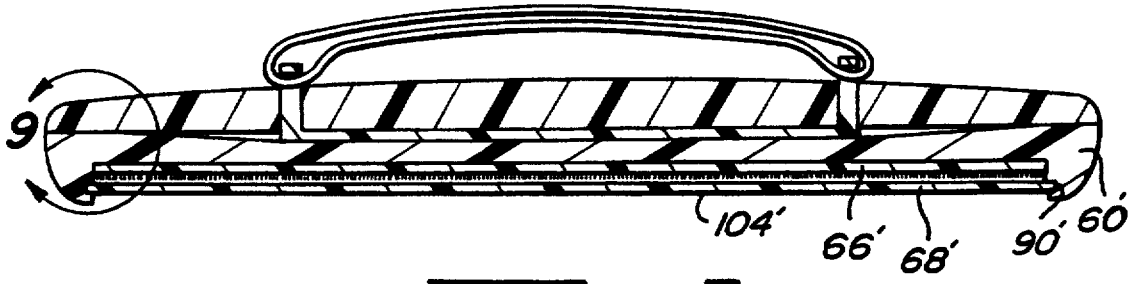
FIG. 8 is a cross-sectional view of a modified form of the target structure of FIG. 5.
Figure 9:
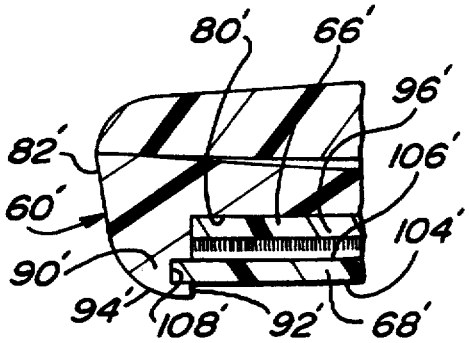
FIG. 9 is an enlarged fragmentary sectional view taken along line 9—9 of FIG. 8 showing the connection between the components of the target structure.
Figure 10:
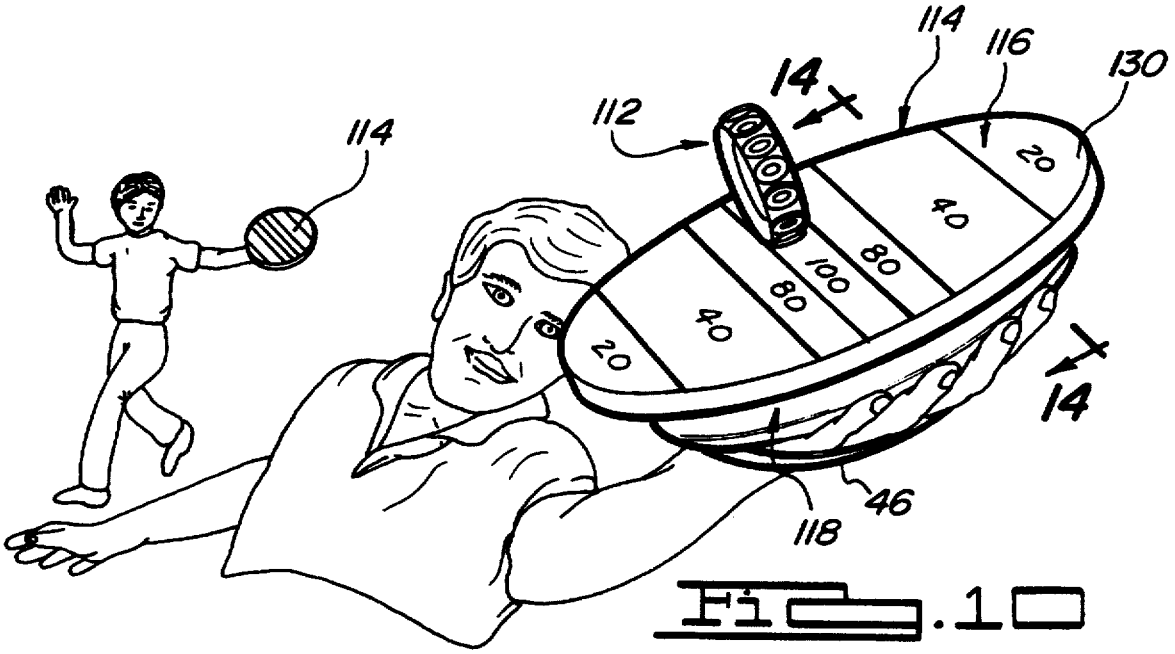
FIG. 10 is a representation showing two players playing with an alternate embodiment of a disk dart and target holder according to this invention.
Figure 11:
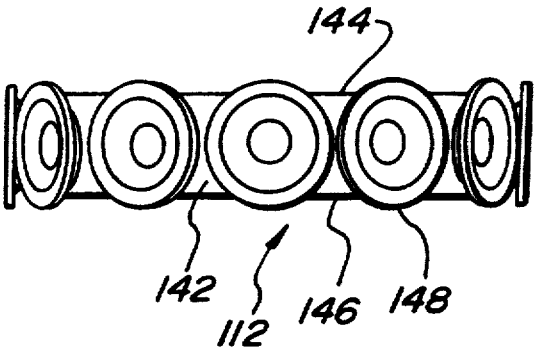
FIG. 11 is a side elevation view of the disk dart shown in FIG. 10.

Turning to FIGS. 8–9, the target holder is slightly modified and like numbers will be used with primes to refer to the structure of this embodiment. The outer periphery 82' of the target holder 60' is formed by a cylindrical wall 90' having an inner face 92' whereby to form a recess and space the outer surface 80' from the front end face 94' of the target holder. As described above, a flat circular plate 96' having an outer periphery corresponding to the configuration of the inner face 92' is adhered to the outer surface 80'. The target plate 96' has Velcro® material arranged thereon whereby to form a first target 66' as described above.

According to this aspect of the invention, the inner face 92' is formed to include a continuous annular groove 108 opening inwardly of the recess and disposed in a horizontal plane spaced upwardly from and parallel to a plane including the Velcro® surface 96'. The groove 108 has a vertical width sized to be slightly greater than the thickness of the outer periphery of a flat circular target plate 68' whereby to permit the periphery of the plate to be flexed at its periphery whereby to be removably "snapped" into and held within the groove 108. When retained the target plate 68' covers the target 66' therebelow. The top and bottom surfaces 106' and 104' of the second target plate 68' preferably are glossy to define different targets for the suction cup projectile, as described above in connection with the embodiment of FIG. 1.

When mounted, the target plate 68' is spaced above the first target 66' provided with Velcro® material. Although the cylindrical wall 90' and its groove 108 are shown as being continuous, the wall could comprise a plurality of angularly separated wall segments whereby to enhance removal of the target plate 68'.

According to another aspect of this invention, it is contemplated that the wall 90 of the target holder 56 could be formed to include the annular groove 108 therearound to removably receive and position the plate 68 having a second target above the first target 66. The second target plate could have Velcro® material adhered to one of its surfaces 104 or 106 and one or both of the surfaces 80 and 104 or 106 would be glossy. Alternatively, the surface 80 could be defined by Velcro® and one or both of the surfaces 104 or 106 could be glossy. As such, the player would be able to use projectiles having either a Velcro® portion or a suction cup portion. The target holder could accommodate two targets with respective Velcro® surfaces and one target with a glossy surface, or two targets with glossy surfaces and one target with a Velcro® surface.

Desirably, a cutout 110 is provided in the outer periphery of the removable target plates 68 and 68'. The cutout is sized to receive a finger from the other hand of the player whereby to enable ease of changing the target plate from the target catching mit without first removing the catch mit.

FIGS. 10–16 illustrate another embodiment of an aerial dart game according to this invention, including a scoring disc dart 112 adapted to be thrown through the air against a target, such as a hand-held target catcher 114. In the embodiment illustrated in FIG. 10, the dart game of the present invention is played by two or more people, each player having the target catcher 114 secured to one hand to catch the disc dart 112 thrown by the other player. It is to be understood that the game could be played by one or more persons in that the disc dart 112 could be projected at a stationary target, such as a target secured to a wall or other suitable structure.

The target catcher 114 is similar to that illustrated in connection with FIGS. 1–4 and includes a rigid circular plate member 116 removably mounted to the front of a circular backing member 118 having a concave shape and a front face 126. The backing member is integrally formed and has inner and outer surfaces 120 and 122, a pair of mounting brackets 124 extending upwardly from the outer surface 122, each bracket having a slot 125 for securing a respective end of the adjustable hand-strap 46, and an annular flange 128 projecting radially outwardly from the outer periphery of the backing member.

The plate member 116 forms the target and includes a relatively smooth outer surface 130 for adherence of the dart 112, an inner surface 132 having a series of concentric reinforcement ribs 24, a resilient annular lip 34 projecting upwardly from the inner surface 132, and an annular shoulder 136 extending radially inwardly from the lip for engagement with the flange 128. As shown, an annular portion of the plate 116, generally indicated by the reference number 138, extends radially outwardly from the lip 134 to increase the diameter of the target and the area of the target surface 130 for retaining the dart. The lip 134 is adapted to clearance fit about the outer periphery of the backing member whereby the inner surface 132 seats against the front face 126 of the backing member and the flange 128 and shoulder 136 form a 360° interlocking engagement.

It is appreciated that the interlocking engagement could be other than shown. For example, if desired, the flange 128 on the outer periphery of the backing meter 118 could be replaced and be formed to include an annular groove extending radially inwardly to receive the shoulder 136 in a snap fit engagement. If desired, the flange 128 could be in the form of a plurality of angularly spaced abutment members to interlock with the shoulder 136, which is continuous and extends 360°. Alternatively, the plate could be formed to include angularly spaced abutment members to interlock with the flange 128, the flange 128 being continuous and extending 360°.

The disc dart 112 comprises a generally cylindrical ring that includes a central axis, generally concentric cylindrical inner and outer surfaces 140 and 142, the inner surfaces 140 being convex and meeting at a cylindrical inner surface **140*a* and the outer surface 142 being concave, axial end faces 144 and 146, and a plurality of resilient suction cups 148 each opening radially outwardly from the surface 142. Preferably, the suction cups are equiangularly spaced around the ring, have forward and rearward ends 148*a* and 148*b* symmetrically arranged on an axis and the respective axes being aligned on a radius extending through the central axis, the respective rearward ends 148*b*** are integrally molded into the ring, and the suction cup axes form a plane that is generally coplanar with the axial end faces 144 and 146. Further, to enhance the likelihood that a suction cup will be presented for adherence to the target, the mass centroid of the ring is positioned to be adjacent to the concave outer surface 142. The width of the ring defined by the axial end faces 144 and 146 is less than the diameter of the forward end 148*a* of the suction cups 148 but is sufficient to embed the rearward end 148*b* of the suction cups.

Figure 12:
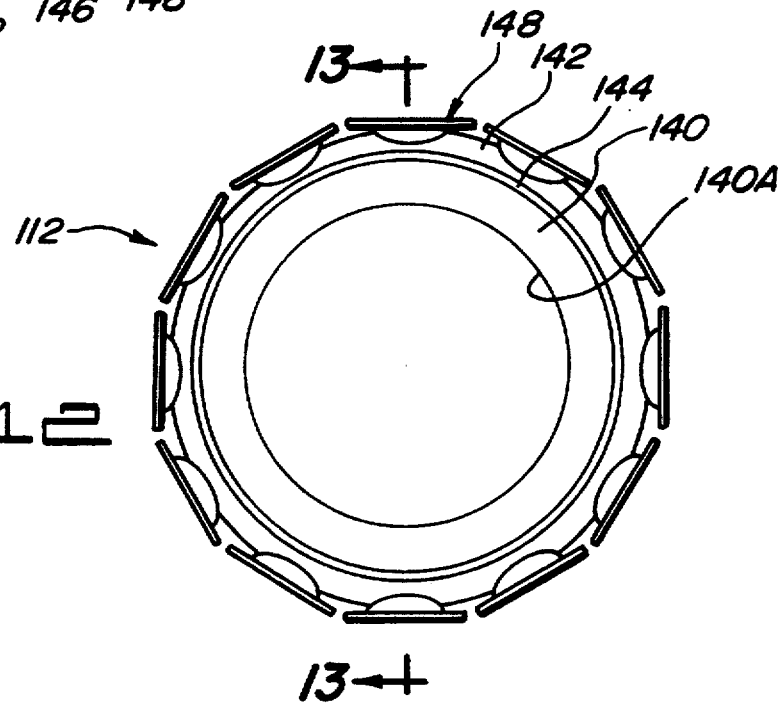
FIG. 12 is a top plan view of the disk dart shown in FIG. 11.
Figure 13:
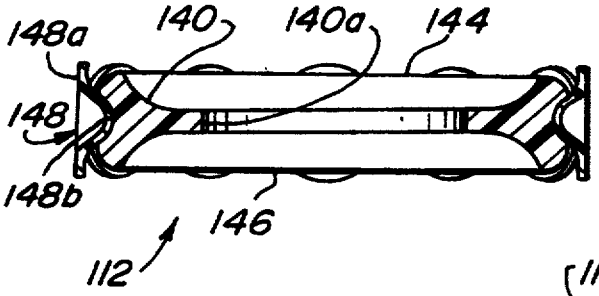
FIG. 13 is a section view of a disk dart, taken along line 13—13 of FIG. 12.
Figure 15:
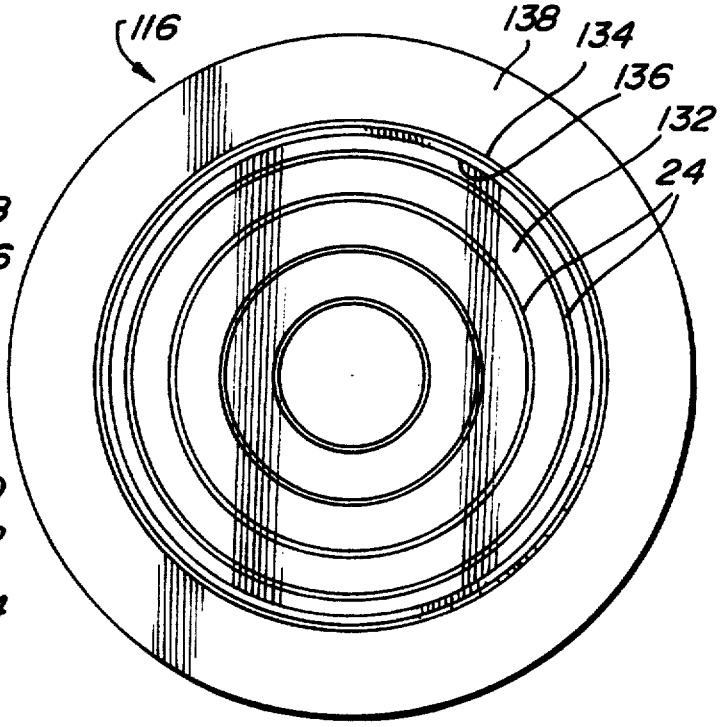
FIG. 15 is a rear view of a target plate, in plan, of the target holder shown in FIG. 14.
Figure 14:
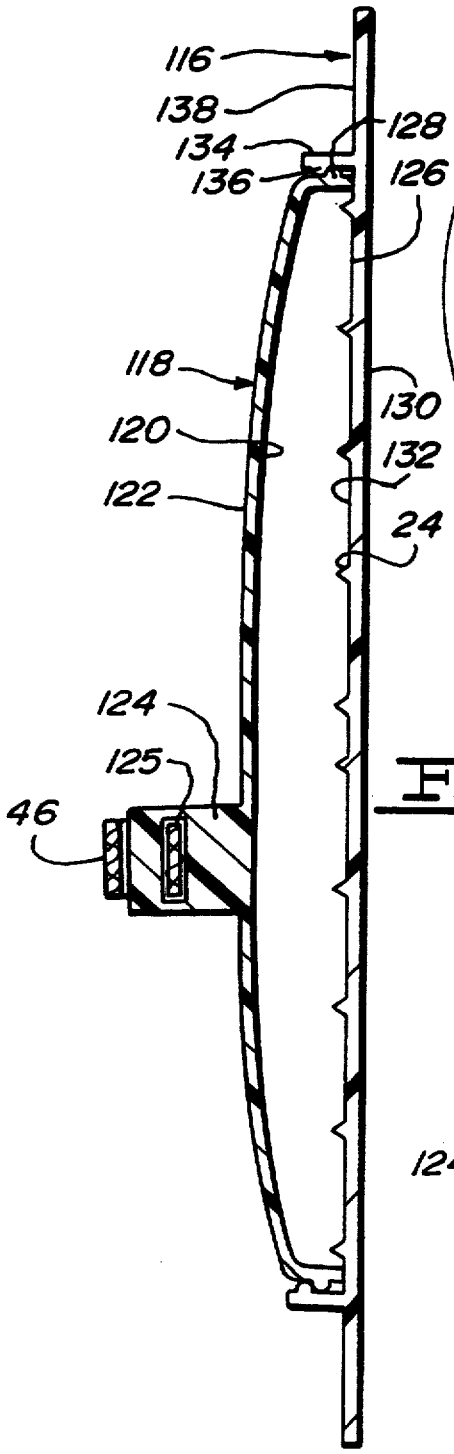
FIG. 14 is a section view of the target holder, taken along line 14—14 of FIG. 10.
Figure 16:
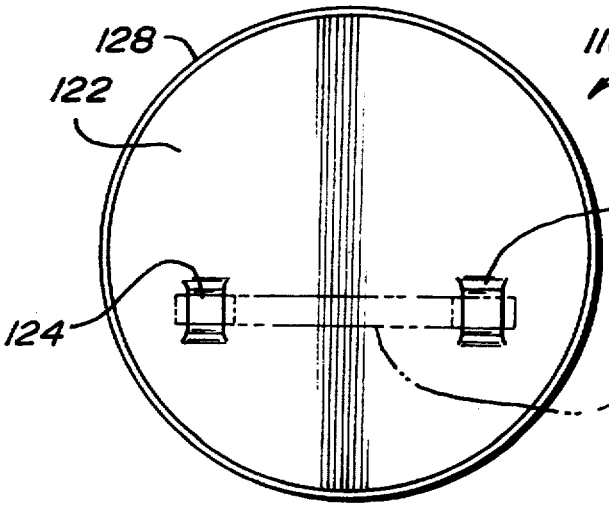
FIG. 16 is a rear view of a backing member, in plan, of the target holder shown in FIG. 14.

In the embodiment shown in FIG. 12, the center of the ring is open. Advantageously, this enables the user to grip the ring for tossing at the target in a rotational motion. If desired, to enhance lift, the center of the ring can be closed by a circular plate member. Referring to FIG. 13, the plate member would have its outer circumference joined to the inner surface portion 140*a*.

In one embodiment, the dart 112 had an outside diameter of about 3½ inches (89 mm). The target 116 had an outside diameter of about 8⅝ inches (220 mm) and the diameter of the resilient lip 134 was about 7⅝ inches (194 mm). Preferably, the dart 112 and target 116 were comprised of a suitable polymeric material.

As an alternate embodiment, a plurality of smaller diameter suction cups could be embedded into the ring such that the resilient portions open radially outwardly from the nonplanar outer surface 142. For example, several rows of suction cups could be arranged in side by side relation on respective circles, or randomly about the surface 142. Advantageously, the centrifugal motion could result in one or more of the cups conforming to and adhering to the target surface.

Those skilled in the art will now come to appreciate some of the advantages of the present invention. The target structure of the present invention allows for greater adherence by the suction cup of the projectile to the outer surface of the plate member. The target structure is also adaptable to provide for a number of different games. The plate member can be detached from the backing member to disclose the inner surface of the backing member which is optionally provided with an additional adhering surface for throwing game. The skilled practitioner will realize still other advantages of the invention after having the benefit of studying the specification, drawings and the following claims.

I claim:

1. In an aerial dart throwing game of the type including a dart and a hand-held dart catcher which is sized so that it can be readily held on one hand for effecting manipulation of the catcher to a position intercepting the line of flight of the dart thrown, said dart catcher comprising a backing member including a front wall having a generally planar outer surface, said front wall being comprised of a rigid material and said outer surface defining a first target for a first dart thrown thereagainst, a plate-like member having generally planar first and second surfaces, said plate-like member being comprised of a rigid material and at least one of said first and second surfaces defining a second target for a second dart thrown thereagainst, and connecting means for removably connecting said plate-like member to said catcher.

2. The dart throwing game as claimed in claim 1 wherein said connecting means comprises the other of said first and second surfaces of said rigid plate-like member and the front wall of said dart catcher each being covered, at least in part, with a portion of Velcro®, said Velcro® portions being adapted to intermesh whereby to connect the plate-like member to the dart catcher.

3. The dart throwing game as claimed in claim 2 wherein said dart catcher includes a peripheral wall projecting upwardly from the outer periphery of said front wall and conforming to the outer peripheral configuration of said outer surface, said wall foxing a recess to receive and each of said targets.

4. The dart throwing game as claimed in claim 1 wherein the front wall of said dart catcher is covered, at least in part, with Velcro® arranged to define said first target for catching only said first dart.

5. The dart throwing game as claimed in claim 1 wherein said connecting means comprises a peripheral wall projecting from said outer surface and presenting inner and outer peripheral faces, and groove means defining an inwardly opening annular groove in said inner peripheral face for receiving the outer periphery of said plate-like member, said annular groove presenting a vertical width that is slightly greater than the thickness of said plate-like member.

6. The dart throwing game as claimed in claim 5 wherein said annular groove is disposed to position the plate-like member in parallel, spaced-apart relation to the outer surface.

7. The dart throwing game as claimed in claim 5 wherein said peripheral wall and said annular groove are continuous, said peripheral wall forms the front wall of the backing member and a recess to space the Velcro® from the front wall, and said groove is adapted to receive and extend 360° around the peripheral end portion of the plate member.

8. The dart throwing game as claimed in claim 7 and further including release means for assisting removal of said plate-like member from the groove and its connection with the target catcher.

9. The dart throwing game as claimed in claim 8 wherein said release means comprises a radially inward cutout portion being provided in the outer periphery of said plate-like member.

10. The dart throwing game as claimed in claim 1 wherein said target catcher comprises a first and a second member each comprising a cylindrical body having upper and lower faces and an outer periphery, said first member including a pair of slots extending between its faces, a holder including an elongated body and a pair of arms, said arms closingly extending through said slots and said body being sandwiched between said lower faces, an adjustable strap connected to the arms, and securing means for fixedly securing said first and second members together.

11. The dart throwing game as claimed in claim 10 wherein said securing means comprises said lower faces being bonded, at least in part, to form an integral body.

12. The dart throwing game as claimed in claim 10 wherein said elongated body is adhered to the lower face of said first member.

13. The dart throwing game as claimed in claim 1 wherein said first and second darts are each in the form of a shuttlecock having a respective forward end adapted to be temporarily secured, respectively, to the first target only and the second target only.

14. The dart throwing game as claimed in claim 13 wherein said first target comprises a Velcro® portion and one surface of said second target comprises a smooth glossy surface, and the forward end of said first and second darts comprises, respectively, a suction cup and a projectile provided with Velcro®.

15. The dart throwing game as claimed in claim 14 wherein the forward end of each of each of said first and second darts is removably attached.

16. The dart throwing game as claimed in claim 1 wherein said first dart is in the form of a ball having Velcro® attached thereto and adapted to be secured to the first target only, and said second dart is in the form of a projectile having a suction cup attached thereto and adapted to be secured to the second target only.

17. In a game, a dart catching target holder presenting a first target on a front face thereof and adapted to receive only a first type of dart thrown thereagainst, a second target adapted to be removably mounted on said target holder in covering relation to said first target on said front face and receive only a second type of dart thrown thereagainst, and connecting means for removably connecting said second target to said target holder.

18. The game as claimed in claim 17 wherein said connecting means comprises a peripheral annular wall upstanding from said front face, and an annular groove formed in said wall, and said second target comprises a relatively rigid plate member having an outer periphery adapted to be removably seated in said groove and thereby position the plate member in covering relation with said first target.

19. The game as claimed in claim 17 wherein said removable second target comprises a rigid plate member having first and second surfaces each forming a target face, and said connecting means comprises said front face, and only one of said first and second surfaces being a material comprised of hook and loop fastener formation.

20. The game as claimed in claim 17 wherein said target holder has a rear face for engagement by the hand of a player and includes means, connected to said rear face, for engaging said hand, and said first and second targets are comprised of a relatively rigid material.

21. The game as claimed in claim 17 wherein said first and second dart each include adherence means for temporarily holding each said dart to its respective target.

22. In an aerial target game of the type including a dart and a hand-held dart catcher which is sized so that it can be readily held on one hand for effecting manipulation of the dart catcher to a position intercepting the line of flight of the dart thrown, said hand catcher comprising a rigid backing member including a front wall having a generally planar surface, a peripheral wall projecting upwardly from the outer periphery of said front wall, said peripheral wall forming a front end face of the backing member and an inner peripheral wall, a groove formed in said inner peripheral wall, a rigid plate having an outer periphery adapted to be removably retained in said groove and presenting a pair of generally planar surfaces, at least one of said surfaces having a hook and loop fastener material applied thereto to form a first target for holding only a first dart thrown thereagainst and another of said surfaces being substantially smooth whereby to form a second target for holding only a second dart thrown thereagainst.

23. The aerial dart game as claimed in claim 22 wherein said backing member comprises a first member having an outer periphery, an outer surface and a mating face, and a second member having an outer periphery and a mating face; first securing means operating between said mating faces for securing the first and second members together whereby the outer peripheries present a smooth periphery; and second securing means connected to said first member for securing the first member to the hand of the player.

24. The aerial dart game as claimed in claim 23 wherein said second securing means includes a strap, and a pair of arms projecting from said outer surface, each arm including an opening for attachment to said strap.

25. The aerial dart game as claimed in claim 23 wherein said peripheral wall is integrally formed with said second member and projects upwardly from the outer periphery thereof to form a front end face of the target catcher and recess said front wall from said front end face.

26. The aerial dart game as claimed in claim 25 wherein said groove extends 360° and operates to receive an entire peripheral edge of the rigid plate.

27. A scoring piece adapted to be thrown through the air at a target having a substantially smooth flat target surface, said scoring piece comprising:

a ring member having a generally cylindrical outer surface facing radially outwardly from a central axis and an inner surface facing radially inwardly and formed by a pair of concave surfaces; and adherence means, including a plurality of suction cups positioned 360° about said outer surface and opening radially outwardly therefrom, for temporarily adhering to said target surface, said suction cups being adapted to be impinged against said target surface and upon such impingement to conform with and adhere to the surface of the target, each said suction cup having a rearward portion and a forward portion arranged on a respective radius from said central axis, said rearward portions being arranged on an imaginary circle the center of which is on said central axis, and the radii of said suction cups being generally disposed in a common plane.

28. The scoring piece as claimed in claim 27 wherein said suction cups have a rearward portion fixedly secured to said ring and an outwardly opening resilient cup portion.

29. The scoring piece as claimed in claim 28 wherein said rear-ward portions are embedded into said ring.

30. The scoring piece as claimed in claim 27 wherein the ring has opposite axial end faces and the suction cup has a diameter that is at least as great as the distance between the end faces.

31. The scoring piece as claimed in claim 27 wherein the ring has opposite axial end faces and the suction cup has a diameter that exceeds the distance between the end faces.

32. In a game of the type including a hand-held target catcher and a projectile adapted to be tossed through the air and adhered to the target catcher, said target catcher being held by the hand and comprising a backing member, a target, and connecting means for removably connecting the target to the backing member, the improvement wherein said target has an outer periphery that is greater than the outer periphery of said backing member, said connecting means is disposed between the outer peripheries of said target and said backing member, and said projectile comprises a cylindrical ring open at its center and having a plurality of resilient suction cups arranged around its outer surface, each cup being adapted to temporarily adhere the ring to the target when adhered thereagainst.

33. The scoring piece as claimed in claim 32 wherein the suction cups are arranged on a circle the center of which is coincident with the center of said ring, the cups opening radially outwardly for adherence to the target.

34. Article for game of selective catching of a projectile, comprising:

a target structure comprising a rigid, generally concave rear backing member, and a ring extending circumferentially about a peripheral edge of said backing member, said backing member including a back surface for engagement by the hand of a player and a front catching layer, and said catching layer comprising a first catching surface of hook elements of complementary hook-and-loop type fasteners; and a cover element removably attachable upon said backing member, said cover element comprising a rim sized for snap fit engagement upon said ring and defining a rigid, generally planar second catching surface adapted to be disposed in front of and extending across said first catching surface.

* * * * *

UNITED STATES PATENT AND TRADEMARK OFFICE

CERTIFICATE OF CORRECTION

PATENT NO. : 5,362,066

DATED : November 8, 1994

INVENTOR(S) : Mark S. Sassak

It is certified that error appears in the above-indentified patent and that said Letters Patent is hereby corrected as shown below:

Col. 1, line 5, "827,464" should be --827,404--;

Col. 1, line 13, after "THE" insert --INVENTION--;

Col. 1, line 52, "made" should be --make--;

Col. 4, line 6, "mit" should be --mitt--;

Col. 4, line 18, "mit" should be --mitt--;

Col. 4, line 54, "sur face" should be --surface--;

Col. 5, line 67, "mit" should be --mitt--;

Col. 5, line 68, "mit" should be --mitt--;

Col. 6, line 29, "34" should be --134--;

Col. 8, line 5, claim 3, "foxing" should be --forming--;

Col. 9, line 2, claim 15, delete second occurrence of "of each"; and

Col. 10, line 45, claim 29, "rear-ward" should be --rearward--.

Signed and Sealed this

Fourteenth Day of March, 1995

*Attest:*

Bruce Lehman

BRUCE LEHMAN

*Attesting Officer*

*Commissioner of Patents and Trademarks*